US006612897B2

(12) United States Patent
Greenberg

(10) Patent No.: US 6,612,897 B2
(45) Date of Patent: Sep. 2, 2003

(54) MUSICAL TOY WITH A MOTOR DRIVEN DISPLAY

(75) Inventor: Michael Greenberg, Gladstone, NJ (US)

(73) Assignee: Shelcore Incorporated, Somerset, NJ (US)

( * ) Notice: Subject to any disclaimer, the term of this patent is extended or adjusted under 35 U.S.C. 154(b) by 0 days.

(21) Appl. No.: 10/058,793

(22) Filed: Jan. 30, 2002

(65) Prior Publication Data

US 2003/0143920 A1 Jul. 31, 2003

(51) Int. Cl.[7] ..... A63H 3/52; A63H 33/30
(52) U.S. Cl. ..... 446/408; 446/143
(58) Field of Search ..... 446/408, 143, 446/227, 71, 409; 84/404

(56) References Cited

U.S. PATENT DOCUMENTS

| | | | | |
|---|---|---|---|---|
| 1,160,319 | A | | 11/1915 | Prout |
| 1,715,158 | A | | 5/1929 | Breitmeyer |
| 1,739,569 | A | | 12/1929 | Behn |
| 2,383,305 | A | | 8/1945 | Greene |
| 2,383,505 | A | | 8/1945 | Greene |
| 2,558,490 | A | | 6/1951 | Koci |
| 2,571,405 | A | * | 10/1951 | Anthony |
| 2,596,866 | A | | 5/1952 | Portogallo |
| 2,788,697 | A | | 4/1957 | Anthony |
| 2,937,475 | A | * | 5/1960 | Crawford |
| 3,159,935 | A | * | 12/1964 | Rubens |
| 3,523,478 | A | | 8/1970 | Van Zanten |
| 4,203,344 | A | * | 5/1980 | Krosnick ..... 84/470 R |
| 4,294,035 | A | | 10/1981 | Klein |
| RE31,667 | E | | 9/1984 | Knauff |
| 4,600,399 | A | | 7/1986 | Abe |
| 4,827,826 | A | * | 5/1989 | Isashi ..... 84/470 R |
| 5,221,225 | A | | 6/1993 | Newbold et al. |
| 5,545,071 | A | * | 8/1996 | Shiraishi ..... 446/143 |
| 5,864,519 | A | | 1/1999 | Nakamura |
| 6,200,193 | B1 | | 3/2001 | Nadel |
| 6,332,824 | B2 | * | 12/2001 | Tell et al. ..... 446/227 |

* cited by examiner

*Primary Examiner*—Derris H. Banks
*Assistant Examiner*—Ali Abdelwahed
(74) *Attorney, Agent, or Firm*—Bacon & Thomas, PLLC

(57) ABSTRACT

A toy includes a housing, a plurality of buttons arranged to initiate playback of a tune or other sounds, a transparent enclosure containing a plurality of balls, an agitator extending into the enclosure, a motor mounted within the housing for causing the agitator to oscillate and propel balls that encounter the agitator against the walls of the enclosure, a sound generator and speaker, and control circuitry for causing the sound generator to play selected sounds upon pressing of one of the buttons, and for intermittently activating the agitator during playback of the sounds. The housing of the toy may be arranged to resemble a piano, and the buttons may be configured to resemble keys of the piano.

14 Claims, 2 Drawing Sheets

MUSICAL TOY WITH A MOTOR DRIVEN DISPLAY

BACKGROUND OF THE INVENTION

1. Field of the Invention

This invention relates to a toy that plays a musical selection or other sounds, and that intermittently activates a visually and aurally surprising kinetic display.

The invention also relates to a toy that plays a musical selection or other sounds, and that intermittently activates a frenetic popping-ball display contained within a transparent enclosure.

The toy of the invention may, in a preferred embodiment, resemble an upright piano, the casing of which houses a motor that causes an agitator to oscillate upon activation, oscillation of the agitator causing balls in the enclosure to be randomly and forcefully propelled against the walls of the transparent enclosure, the rapid impact of the balls against the enclosure creating a loud popping sound.

2. Description of Related Art

A popular toy for infants and very young children is a musical toy that plays short song selections upon pressing a button. The buttons are generally large, and may be lighted to add visual interest and facilitate pressing by the infant or child, while the housing of the toy may be arranged to resemble a musical instrument and/or to support figures that move in response to a mechanical linkage to the buttons.

Another popular children's toy is the "surprise" toy, an example of which is the jack-in-the-box. In the traditional jack-in-the-box, the child turns a crank to activate a mechanism that causes music to be played for a period of time, after which a clown figure suddenly pops out of the box.

A final well-known children's toy of interest to the present invention the so-called popper, which generally includes an inclined or conical surface that feeds balls to a rapidly oscillating diaphragm or agitator, causing the balls to be forcefully projected in seemingly random fashion against the walls of a transparent enclosure and create a loud popping sound.

The present invention is a toy that combines the entertaining features of all three of the above well-known types of toys. In one embodiment of the present invention, the toy takes the form of a toy piano that permits an infant or young child to play tunes or other sounds, such as animal sounds or narration, upon pressing of a button. An element of surprise similar to that of a jack-in-the-box, in which motion occurs unexpectedly, is then added, the unexpected motion being caused by a motor-driven popper that provides sustained frenetic motion and noise. The effect is quite startling and sure to hold the attention of an infant, and even of a toddler otherwise jaded by the constant activity of modern life.

Aside from the related art represented by the above-described well-known toys on which the present invention is based, three prior patents disclose toys or mechanisms that combine music and motion effects, though not with the same dramatic effect of the present invention.

In two of these patents, a keyboard is combined with a key-activated ball motion display, but because the key motion itself moves the ball, without a motor to add energy to the motion, or initiation of motion during playback of a tune, the effect of the ball motion is entirely different than that provided by the invention. In the first of these patents, U.S. Pat. No. 2,383,305, depression of keys causes lifting of a ball via a mechanical linkage to an inclined runway having metal plates arranged to play a musical scale as the ball descends. In the second patent, U.S. Pat. No. 2,788,697, depression of keys causes a ball to jump in a transparent enclosure, but the jumping occurs simultaneously with pressing on one of the keys to play a note.

U.S. Pat. No. 2,558,490, in contrast, discloses electrically activated motion during playing of a tune, but the motion is in response to electric currents generated by the vibrating stylus of a phonograph. In one embodiment, cessation of sound from the phonograph activates a motor that closes a curtain and, in other embodiments, the electric currents are used to animate an electro-mechanical orchestra. At no time are the resulting motions intended to be unpredictable, and the music is not activated by pushing buttons operable by an infant or young child. In addition, there is no analogue to the frenetic popping motion of the invention. Instead, the "toy" disclosed in his patents seems more suitable for use by older children and adults than by infants and toddlers.

SUMMARY OF THE INVENTION

It is accordingly a first objective of the invention to provide a musical or sound playing toy that provides stimulation for a child beyond that which can be provided by music or sounds alone.

It is a second objective of the invention to provide a musical or sound playing toy that intermittently provides a surprise visual and aural special effect as a musical selection is being played.

It is a third objective of the invention to provide a kinetic display for a musical or sound playing toy.

It is a fourth objective of the invention to provide a toy piano arranged to provide both aural and visual effects.

It is a fifth objective of the invention to provide a musical toy with surprising visual and aural effects that can be operated by an infant or very young child.

These objectives are achieved, in accordance with the principles of a preferred embodiment of the invention, by providing a toy having a housing, a plurality of buttons arranged to initiate playback of a tune or other types of sounds, a transparent enclosure containing a plurality of balls, an agitator extending into the enclosure, a motor mounted within the housing for causing the agitator to oscillate and propel balls that encounter the agitator against the walls of the enclosure, a sound generator and speaker, and control circuitry for causing the sound generator to play selected tunes or generate other sounds upon pressing of one of the buttons, and for intermittently activating the agitator during playback of the tune.

In the illustrated embodiment of the invention, the housing of the toy is arranged to resemble a piano, and the buttons are configured to resemble keys of the piano.

DETAILED DESCRIPTION OF THE PREFERRED EMBODIMENTS

Figure 1:
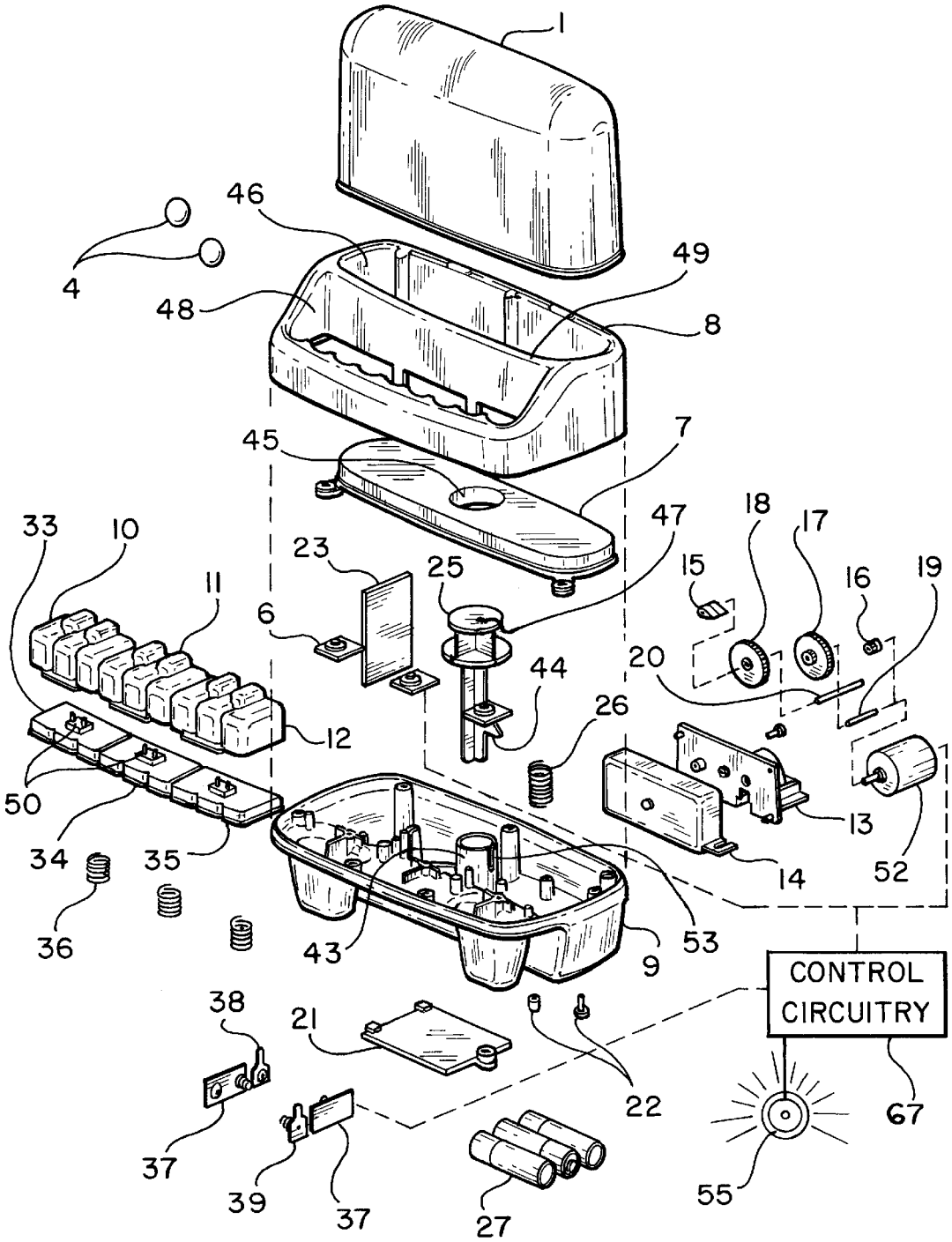
FIG. 1 is an exploded isometric view of a toy constructed in accordance with the principles of a preferred embodiment of the invention.
Figure 2:
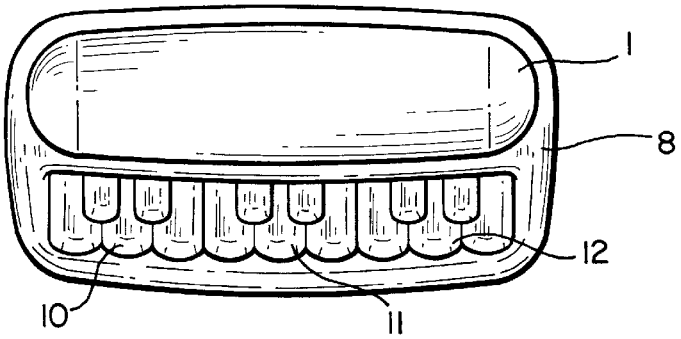
FIG. 2 is a top view of the toy illustrated in FIG. 1.
Figure 3:
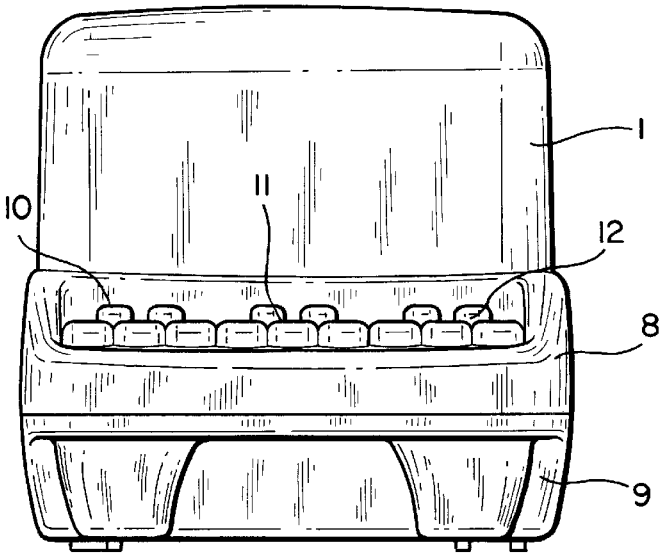
FIG. 3 is a front view of the preferred toy.
Figure 5:
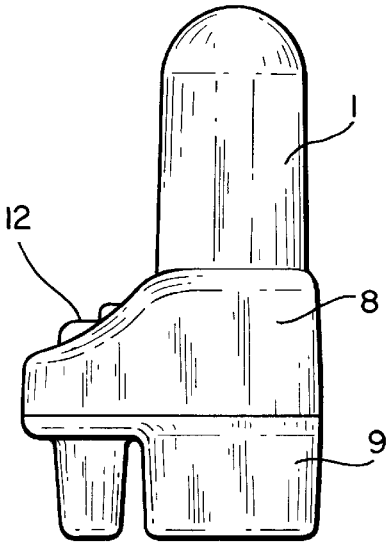
FIG. 5 is a side view of the preferred toy.
Figure 4:
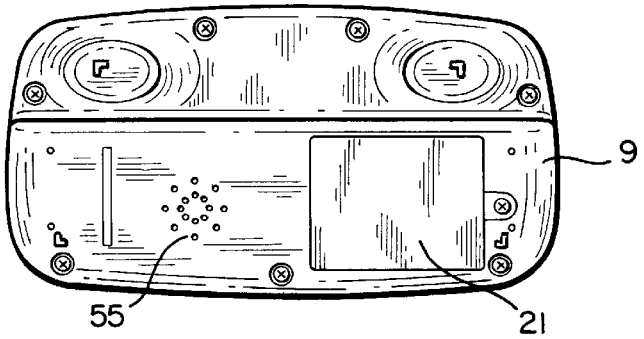
FIG. 4 is a bottom view of the preferred toy.

As illustrated in FIGS. 1–5, the toy of the invention is arranged to resemble an upright piano, and includes a main housing made up of an upper housing 8, a lower housing 9, and a transparent enclosure 1. Upper housing 8 is arranged to support a plurality of "key" assemblies 10–12, while lower housing 9 is arranged to house a popper mechanism and control circuitry.

The upper housing 8 includes a front section 48 for supporting the key assemblies, and a rear section 46 for supporting the enclosure 1. The front and rear sections of the upper housing are separated by a partition wall 49, and the rear section is further separated from the lower housing by a divider 7, which forms a floor of the enclosed popping chamber defined by rear section 46 and transparent enclosure 1. Divider 7 includes an opening 45 through which extends an agitator 25 of the popper mechanism.

The key assemblies 10–12 serve as buttons that may easily be manipulated by a young child. As illustrated, each assembly is molded to resemble a group of piano keys, and are made of a transparent or translucent material, which may be colored, to enable illumination of the keys by fighting elements 50 positioned on reflectors 33–35 that form the bases of the keys. The key assemblies 10–12 are further positioned above a set of switches 6 and include coil spring suspensions 36 to restore the key assemblies to an original position after pressing the key assemblies to activate any of the switches 6. Switches 6 are connected to a control circuit 67 powered by a set of batteries 27 connected to the control circuit by contact sets 37–39 situated within a battery compartment accessible through battery compartment cover 21 releasably secured in well-known fashion by screw capture system 22.

Control circuit 67 on printed circuit board 23 initiates, in conventional fashion, playback of one of a plurality of tunes or other sounds through a speaker 55, depending on which button is pushed, and optionally sequences illumination of the buttons. Appropriate integrated circuit-based controllers are well-known and readily available, and the details of the control circuit 67 form no part of the present invention except for the inclusion of a function, easily programmed into a typical controller by those skilled in the art, of generating an intermittent motor activation signal.

An example of a sound or song-playing sequence controlled by circuit 67, which is not intended to be limiting, is as follows:

First, the user presses one of the key assemblies 10–12 to hear a song or a particular sound sequence. While the sound or song sequence plays, the keys light up and the lights blink in sync with the music or sounds.

At a certain point during the song or sound sequence, the motor drive signal activates the motor, causing the balls 4 to pop for approximately 1.5 seconds while the music or sounds continue. The popping cycle repeats two to five times depending on the length of the song or sound sequence.

In the case of musical selections, the songs are preferably non interruptible, so that the child can pretend to play the piano along with the music.

Once the song or sound sequence ends, another key assembly may be pressed to hear the next of eight different songs or sound sequences.

If the key assembly is not pressed for 30 seconds, a short melody or other sound effect may automatically come on as an invitation to play.

Although a specific example of a sound/popping sequence is described above, those skilled in the art will appreciate that the number of different tunes available for selection, the manner in which the tunes are selected when a particular button is pushed, and whether the tunes are generated by a synthesizer or tone generator, or retrieved from a memory, are all freely selectable by those skilled in the art, and also form no part of the present invention. In addition, the motor activation signal may close a switch to start a pre-programmed or timer-based motor driving sequence, or may directly drive the motor, and the motor may be driven for a fixed or random period of time, while the timing of the motor activation signal may be fixed relative to initiation of a song or other sounds, or may begin at random times during playback. Playback of the sounds may cease during motor activation, or may continue.

The motor 52 may be a simple DC motor having a rotary output shaft. The output shaft is coupled to a cam 15 by a gear train consisting of pinion 16, and gears 17 and 18 mounted respectively on shafts 19 and 20 within gear box housing 13 and cover 14. The purpose of the gear train is to increase the speed at which actuator cam 15 rotates in response to turning of the motor, so as to maximize the oscillation frequency of an agitator 25.

Agitator 25 is mounted in a support 43 having a slot 53 for permitting vertical movement of a cam follower extension 44. A coil spring 26 biases the agitator to an upward position such that each time cam 15 rotates to a position at which it engages cam follower extension 44, agitator 25 is pushed downward against the force of the coil spring 26 until the cam 15 clears the extension 44, at which time the restoring force of spring 26 causes the agitator to rapidly return to an upward position, propelling any ball 4 that happens to be on the top surface 47 of the agitator against the walls of enclosure 1, causing the propelled ball to make a loud popping sound.

To provide an even more random ball-popping effect, the balls may have different diameters. The number of balls 4 will depend on the size of the enclosure, but for a typical musical toy having a size suitable for handling by an infant or toddler, a possible number of balls 4 is 11, with the diameters of the balls 4 ranging from 6 mm to ¾ in. The top surface of divider 7 is illustrated as flat since the rapidly oscillating agitator will create sufficient ball motion even without curving the surface so that the balls are fed more rapidly to the agitator, although it is also within the scope of the invention to include an inclined or curved ball-feeding surface. In addition, instead of a rigid agitator, it is within the scope of the invention to provide an elastic membrane or diaphragm that can be vibrated to propel the balls.

Having thus described a preferred embodiment of the invention in sufficient detail to enable those skilled in the art to make and use the invention, it will nevertheless be appreciated that numerous variations and modifications of the illustrated embodiment may be made without departing from the spirit of the invention, for example by varying the configuration of the housing to resemble something other than a piano, or by replacing popping balls with another type of frenetic motor-driven motion effect, and it is therefore intended that the invention not be limited by the above description or accompanying drawings, but that it be defined solely in accordance with the appended claims.

I claim:

1. A toy, comprising:

at least one button;

control circuitry arranged to play sounds upon pressing the button, and to intermittently generate a motor actuation signal after playing of the sounds has begun;

a motor arranged to be intermittently actuated by said motor actuation signal so as to be turned on and off at least two times; and a mechanism driven by the motor for providing, while said sounds are being played:

an initial period when the motor is turned off, said mechanism is not driven, and no motion occurs;

followed by a period when said motor is turned on and said mechanism is driven to cause a sudden, frenetic, motion;

followed by a period when the motor is again turned off, said mechanism is not driven, and no motion occurs;

followed by at least one second period when said motor is turned on and said mechanism is driven to cause said sudden frenetic motion, wherein said mechanism is a ball popper mechianism, wherein said ball popper mechanism comprises an agitator that extends into a transparent enclosure containing a plurality of balls, said agitator being driven by said motor to oscillate into and out of said enclosure and cause any balls that encounter the agitator to be propelled against walls of the enclosure with sufficient force to make a loud popping sound.

2. A toy as claimed in claim 1, wherein said agitator is biased in an upward direction by a spring, and further includes a cam follower extension that is repeatedly engaged by a rotating cam to cause the agitator to be pressed downward against a bias provided by said spring, wherein release of the agitator causes the agitator to be forced rapidly upward in response to said bias.

3. A toy as claimed in claim 2, further comprising a gear train coupled between said motor and said cam for increasing a rotational velocity of said cam.

4. A toy as claimed in claim 1, wherein a housing of the toy is arranged to resemble an upright piano, and said at least one button is arranged to resemble at least one key of said piano.

5. A toy as claimed in claim 4, further comprising at least one additional button.

6. A toy as claimed in claim 4, wherein said button is illuminated.

7. A toy as claimed in claim 1, wherein said sounds are musical selections.

8. A toy, comprising:

at least one button;

control circuitry arranged to play sounds upon pressing the button, and to intermittently generate a motor actuation signal after playing of the sounds has begun;

a motor arranged to be intermittently actuated by said motor actuation signal; and a mechanism driven by the motor for providing a sudden, frenetic, motion, wherein said mechanism is a ball popper mechanism and said ball popper mechanism comprises an agitator that extends into a transparent enclosure containing a plurality of balls, said agitator being driven by said motor to oscillate into and out of said enclosure and cause any balls that encounter the agitator to be propelled against walls of the enclosure with sufficient force to make a loud popping sound.

9. A toy as claimed in claim 8, wherein said agitator is biased in an upward direction by a spring, and further includes a cam follower extension that is repeatedly engaged by a rotating cam to cause the agitator to be pressed downward against a bias provided by said spring, wherein release of the agitator causes the agitator to be forced rapidly upward in response to said bias.

10. A toy as claimed in claim 9, further comprising a gear train coupled between said motor and said cam for increasing a rotational velocity of said cam.

11. A toy as claimed in claim 8, further comprising a housing arranged to resemble an upright piano, wherein said at least one button is arranged to resemble at least one key of said piano.

12. A toy as claimed in claim 11, wherein a number of said buttons is at least two further comprising a second said at least one button.

13. A toy as claimed in claim 11, wherein said button is illuminated.

14. A toy as claimed in claim 9, wherein said sounds are musical selections.

* * * * *